US006298628B1

(12) United States Patent
Nakao

(10) Patent No.: US 6,298,628 B1
(45) Date of Patent: Oct. 9, 2001

(54) BLOCKS FOR WALL SURFACE OF HOUSES

(76) Inventor: Shigeo Nakao, 36-2, Oaza Iwato, Takachiho-cho Nishiusuki-gun (JP)

( * ) Notice: Subject to any disclaimer, the term of this patent is extended or adjusted under 35 U.S.C. 154(b) by 0 days.

(21) Appl. No.: 09/623,869

(22) PCT Filed: Jan. 21, 1999

(86) PCT No.: PCT/JP99/00234

§ 371 Date: Sep. 11, 2000

§ 102(e) Date: Sep. 11, 2000

(87) PCT Pub. No.: WO00/43606

PCT Pub. Date: Jul. 27, 2000

(51) Int. Cl.[7] ..... E04B 2/00

(52) U.S. Cl. ..... 52/583.1; 52/590.2; 52/600; 52/604; 52/605

(58) Field of Search ..... 52/583.1, 590.2, 52/600, 604, 605, 608

(56) References Cited

U.S. PATENT DOCUMENTS 1,448,648 * 3/1923 Wilkins ..... 52/605
2,847,847 * 8/1958 Moore ..... 52/590.2
2,902,733 * 9/1959 Justus ..... 52/583.1

FOREIGN PATENT DOCUMENTS 5-163771 * 6/1993 (JP) ..... 52/605

* cited by examiner

*Primary Examiner*—Carl D. Friedman
*Assistant Examiner*—N. Slack
(74) *Attorney, Agent, or Firm*—Sheridan Ross P.C.

(57) ABSTRACT

The present invention presents a block which by layer-building therewith, can be used to form walls so that a log house can be constructed with ease. With the present invention, rainwater which has penetrated through the areas where the blocks are linked is prevented from coming through to the inside wall side. The present invention also increases the surface area supporting the weight of the block thereby reinforcing the strength of the building.

A block 1 is comprised of a hook-shaped joint 2, a linking protrusion 3, a linking groove 4, and an insertion through hole 5. A first slanting surface 31 which is slanted away from one side and toward the other side is formed in the top of the linking protrusion 3 together with a second slanting surface 32 which faces toward the one side and away from the other side. Flat surfaces 33 and 34 are formed on both ends of these slanting surfaces which are higher than each of these slanting surfaces. A center flat surface 35 which is higher than each of the slanting surfaces is formed between the first slanting surface 31 and the second slanting surface 32.

15 Claims, 10 Drawing Sheets

1
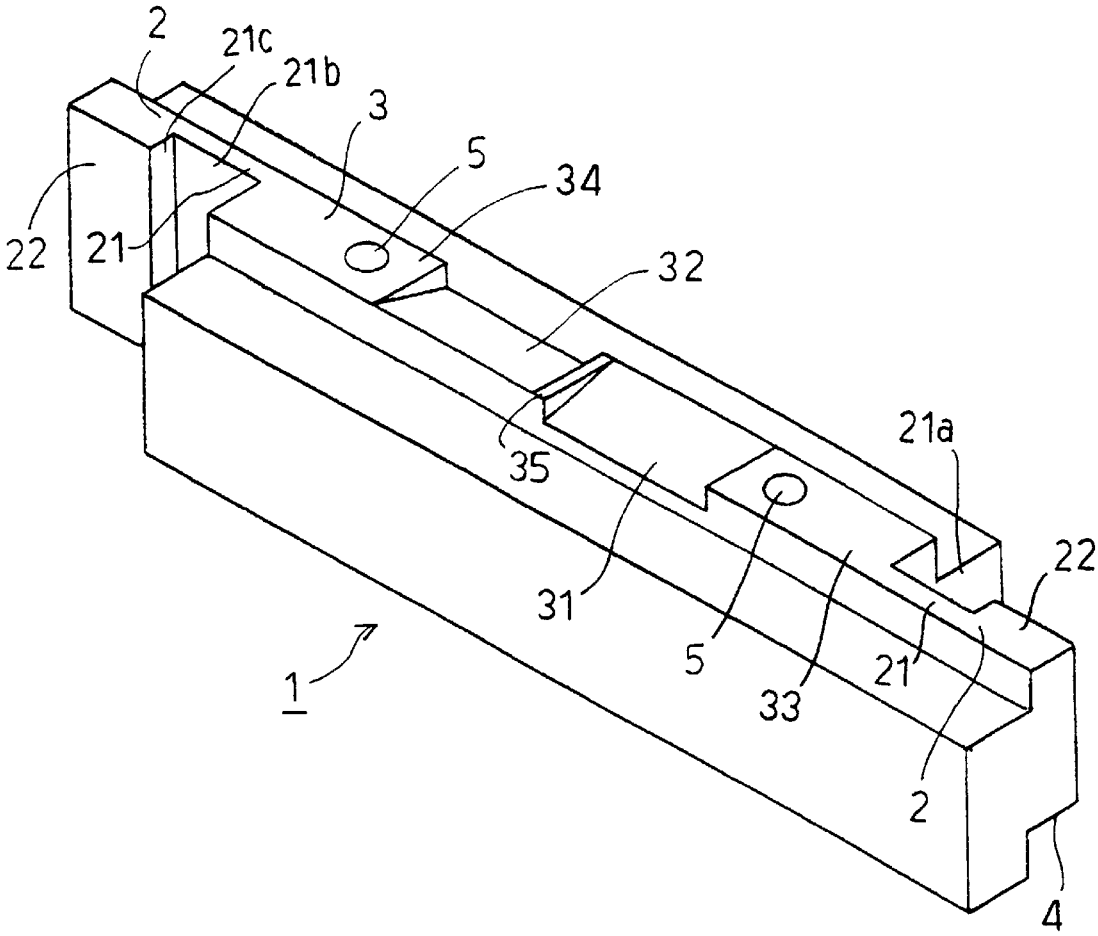

2
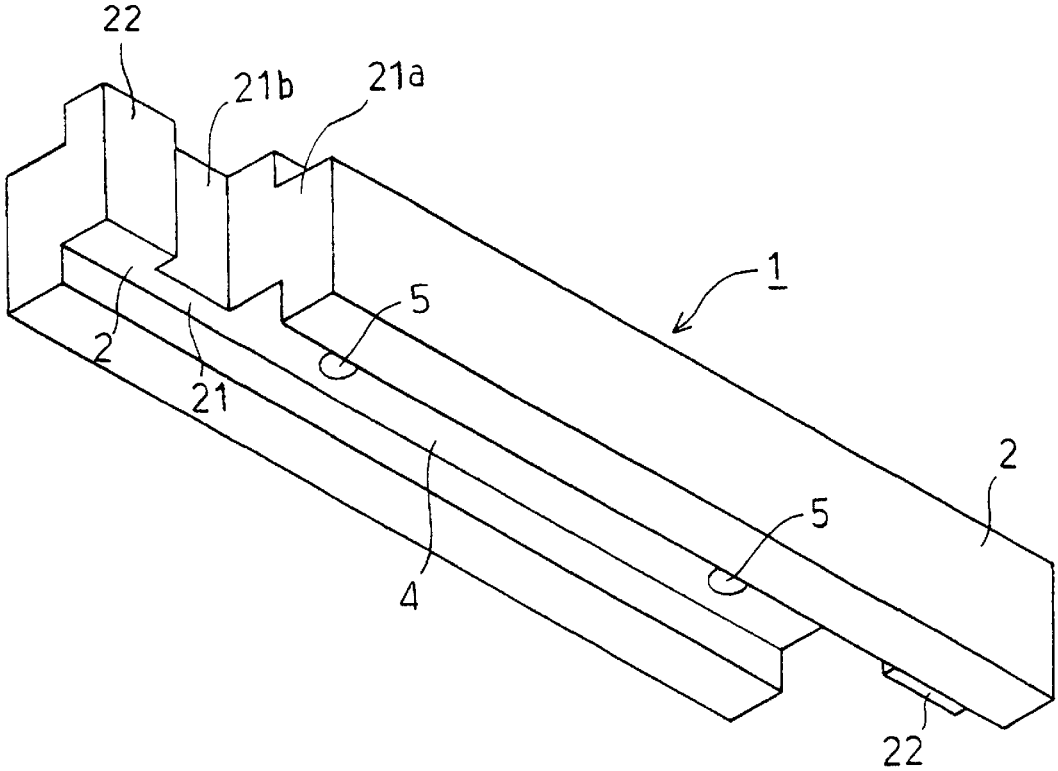

3
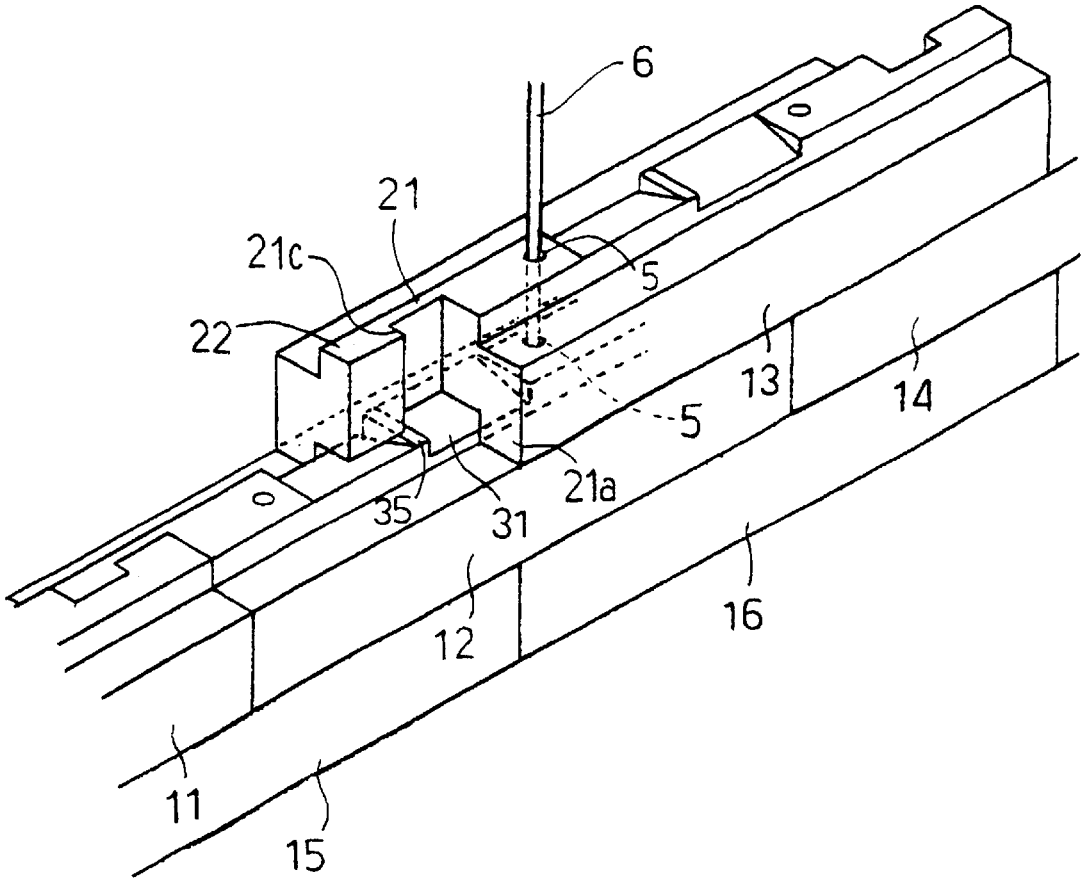

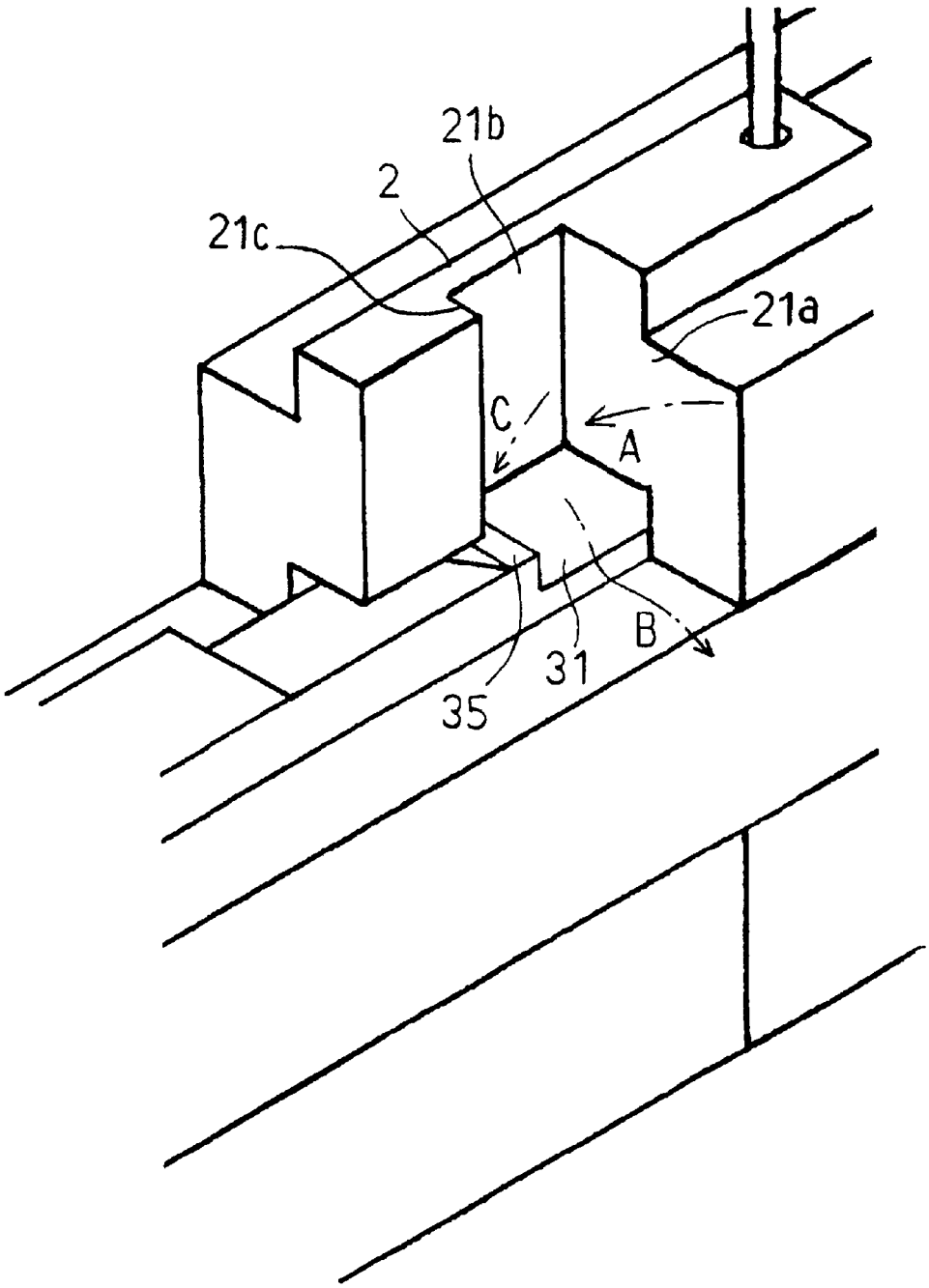
21b
2
21c
21a
C
A
B
31
35

5
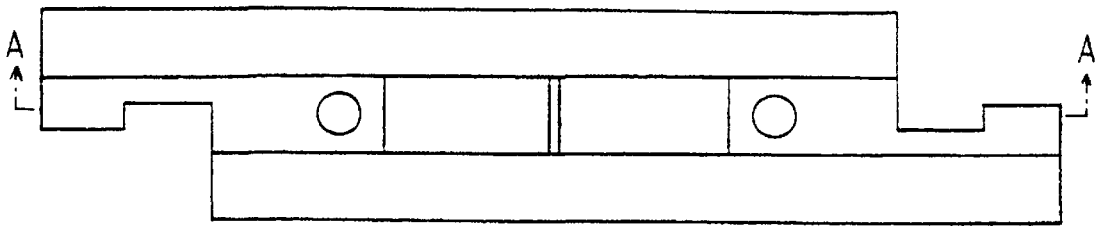
6
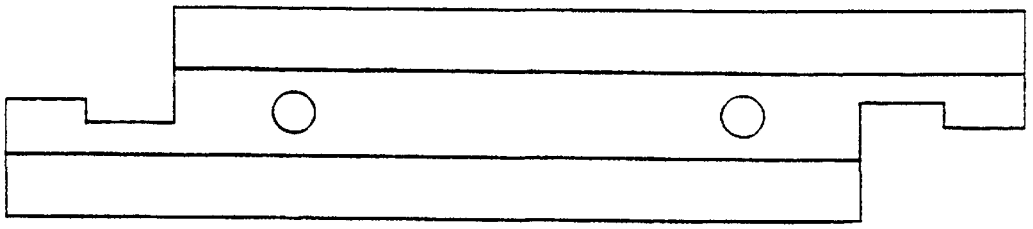

7
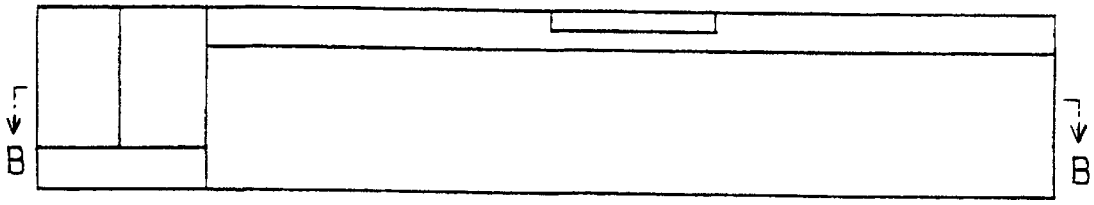
8
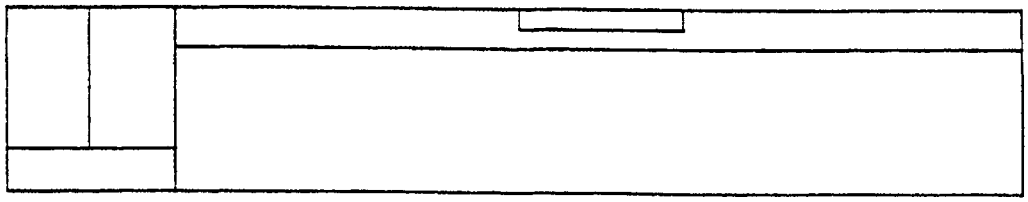

9
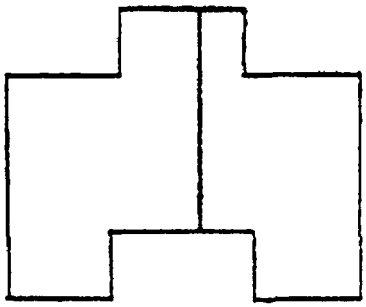
10
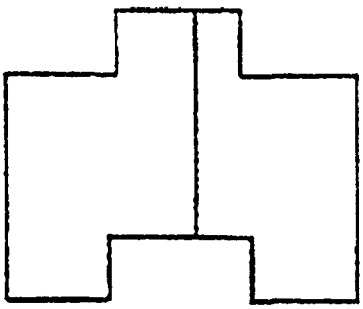

1 1
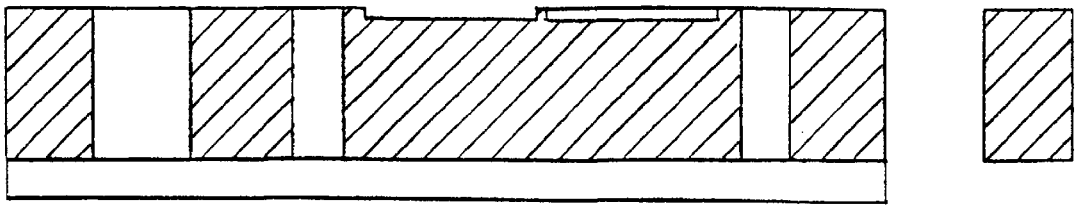
1 2
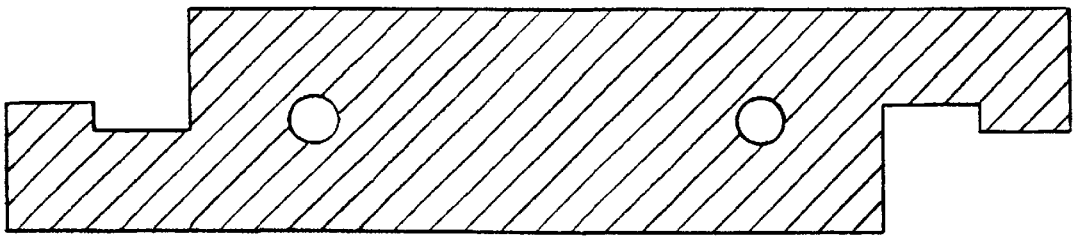

13
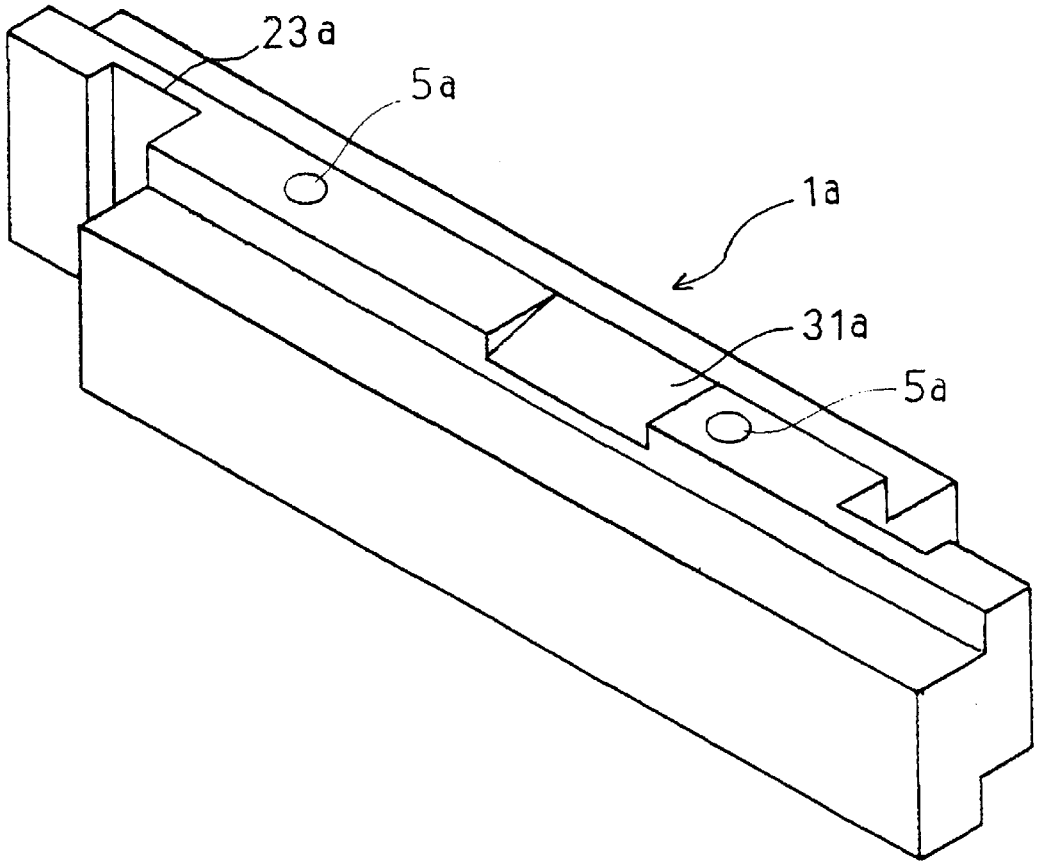

14
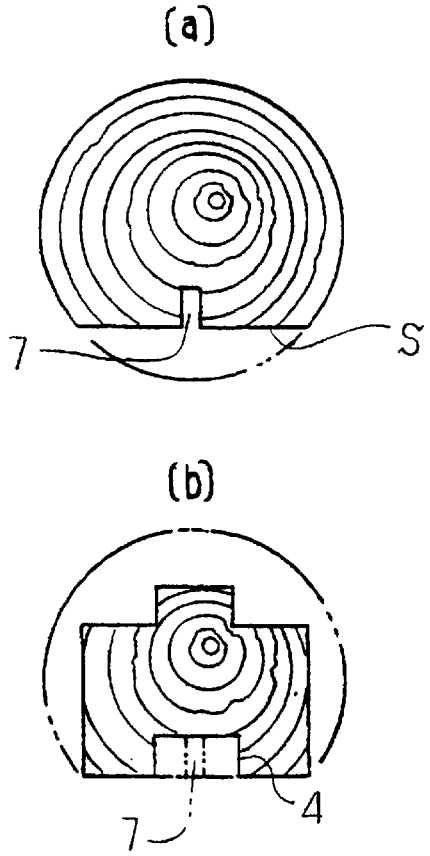
15
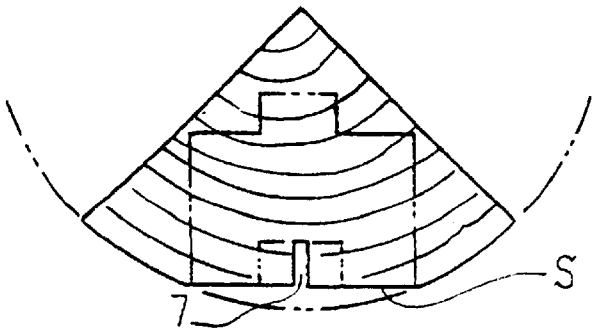

BLOCKS FOR WALL SURFACE OF HOUSES

TECHNICAL FIELD

The present invention relates to blocks, specifically wooden blocks, which, by layer-building with a plurality thereof, are used to form the walls of houses and buildings.

BACKGROUND OF THE INVENTION

Buildings in which the walls are formed by layer-building with timbers have been widely employed in the form of log cabins and log houses. The increasing "outdoor" trend of recent years has led to an increased demand for log houses. Notwithstanding their appearance due to their natural wood grain, these types of log houses are advantageous in that the interior can be maintained at the proper humidity because the timbers which form the walls breath. Such advantages, which artificial building materials do not have, should not be overlooked.

Original log houses are quite difficult for an individual to construct: uniform timbers are difficult to procure, and specialists are needed to machine the materials as well as in the design and construction.

Accordingly, with the object of enabling non-specialists to construct a comparatively simple log house without the use of specialized technology or equipment, the applicant of the present invention disclosed the invention of "Wood Blocks" in Japanese Unexamined [Kokai] Patent Publication No. Hei. 2-17711 [1990] and Japanese Examined [Kokuku] Patent Publication No. Hei. 6-50007 [1994].

These wood blocks form walls similar to those that are obtained when long angular timbers are layered on each other. This is done by layer-building not with long timbers but by joining short block-like wooden materials together. Specifically, the blocks are horizontally linked at joints in both ends, the top and bottom of the blocks are linked by protrusions and grooves formed in the top and bottom surfaces thereof, and an slanting surface is formed in the protruding area in the top. As a result of such a construction, rainwater that has penetrated through the joining areas is drained.

In particular, the invention disclosed in Japanese Examined [KoKoKu] Patent Publication No. Hei. 2-6-50007 [1994] has a construction in which the inside and outside are reversible. This is made by forming reciprocally slanting surfaces on each side of the block with an area in the vicinity of the centerline of the block acting as a boundary therebetween, so that regardless of the inside/outside orientation of the block, rainwater that has penetrated through the joining surfaces in the joints of the blocks is drained to the outside.

As a result of this construction, a wall that is resistant to wind and rain can be easily formed with a very simple procedure by relying on bolts that are established on the foundation.

Similar to the aforesaid invention disclosed by the applicant of the present invention, this invention also uses block-like building materials to form walls by layer-building. However, the object of the present invention is to provide blocks for walls in houses and buildings in which the structure of the walls formed are longitudinally reinforced, and in which the measures for keeping out rainwater are augmented.

SUMMARY OF THE INVENTION

In order to attain this object, the present invention comprises a block, which, by layer-building with a plurality thereof, is used to form walls in houses and buildings. This block comprises: hook-shaped joints established at both of its ends; a linking protrusion established in the top of the block which protrudes in the direction of both ends; a linking groove established in the bottom of the block which links with the linking protrusion of another block positioned therebelow; a first slanting surface positioned on the top of said linking protrusion and to the right of the approximate center of said block, which is slanted away from one side and toward the other side; a second slanting surface positioned on the top of said linking protrusion to the left of the approximate center of said block, which is slanted toward the aforesaid one side and away from the aforesaid other side of the block; and whereby said block is characterized in that a flat surface that is higher than each of the slanting surfaces is established in both ends of the aforesaid linking protrusion of said block.

As a result of this construction, rainwater, which due to the hook-shaped joint, has penetrated through the linking area, is more reliably drained than it is in the prior invention disclosed by the applicant of the present invention. Moreover, the outflow of water to the inside wall side, that is a concern due to the capillary phenomenon, can be blocked using incomplete walls at both ends of the block. In addition, because the weight of the layered blocks is supported by adhering the flat surface of the linking protrusion to the linking groove, it is stronger than in the prior art in which the entire joining protrusion is formed on the slanted surface. Furthermore, because this block is inside/outside reversible, the joints of the blocks can easily be joined without having to pay attention to which side is the inside and which is the outside when layering the blocks.

On the other hand, a block that is not inside/outside reversible can also be formed by not establishing the aforesaid second slanting surface. In this case, one must confirm which side is the inside and which is the outside when layer-building using these blocks. However, because the area of the flat surface on the top of the linking protrusion is wider than it is in the aforesaid block, the block is strengthened in that area.

BRIEF DESCRIPTION OF THE DRAWINGS

FIG. 1 is an oblique view of the block of embodiment 1 as viewed from above.

FIG. 2 is an oblique view of the block of embodiment 1 as viewed from below.

FIG. 3 is an oblique view showing the blocks of the embodiment 1 in a layered condition.

FIG. 4 is an enlarged oblique view of the joining area shown in FIG. 3.

FIG. 5 is a planar view of the block of embodiment 1.

FIG. 6 is a view of the bottom face of the block of embodiment 1.

FIG. 7 is a front view of the block of embodiment 1.

FIG. 8 is a rear view of the block of embodiment 1.

FIG. 9 is a view of the right side of the block of embodiment 1.

FIG. 10 is a view of the left side of the block of embodiment 1.

FIG. 11 is a front cross section of the block along the line A—A in FIG. 5.

FIG. 12 is a planar cross section of the block along the line B—B in FIG. 7.

FIG. 13 is an oblique view of the block of embodiment 2 as viewed from above.

FIG. 14 is a schematic showing the method for manufacturing the wooden blocks.

FIG. 15 is a side view of the usage condition of the timber in another method for manufacturing the wooden blocks.

DETAILED DESCRIPTION

In the blocks disclosed by the inventor of the present invention in a prior invention, the joining protrusion on the top of the block is formed on the slanting surface. In the present invention, a dike is formed by forming a flat surface which is higher than the slanting surface. As a result, rainwater that has penetrated through the joining area between adjacent blocks cannot flow between the linking protrusion and the linking groove. In addition, by forming this flat surface in such a way that it adheres with the linking groove of another block positioned thereabove, not only is the gap between the linking protrusion and linking groove that is formed in the prior art blocked off, but also the weight of the layered blocks and the roof is supported which can increase the strength of the building overall.

Furthermore, in a block that has an inside/outside reversible structure in which slanted surfaces are alternately established on both the exterior and inside wall sides, a center flat surface which is higher than the slanting surfaces is formed in the boundary area between the two slanting surfaces that are slanted in opposite directions. As a result, rainwater that has penetrated through the joint (as is described in detail in the embodiments below) is prevented from reaching the slanting surface on the other side which slants in the direction of the inside wall. In order to position the block so that respective positions of the joining area and the center flat surface are reliably maintained, insertion through holes are established in the block so that by passing a vertical bar erected in a standing position from the foundation through the insertion through hole, the aforesaid positioning is secured. As a result, the cuff area of the joint is positioned above the center flat surface which prevents water from flowing out to the opposite side as described above.

There are no particular restrictions regarding the material used for the block of the present invention. It goes without saying that it can be made of wood, and can also be formed out of a material such as resin, metal or ceramic, etc. For example, when made of resin, the methods used for forming educational toys, etc., can be applied, and when made of flame resistant ceramic or concrete, an incinerator, can be applied in the forming. The blocks of the present invention are joined using their shape and vertical bars, thus they can be widely used to form walls without the special use of a binding agent.

Each embodiment of the present invention is explained below based on the figures.

Embodiment 1

An inside/outside reversible block is explained in embodiment 1 of the present invention.

As shown in FIG. 1., the block 1 in this embodiment is comprised of hook-shaped joints 2 established at both of its ends; a linking protrusion 3 which has a protruding step and is formed on the top of the block toward both ends; a linking groove 4 which is established on the bottom face of the block and which links with the linking protrusion 3 of another block 1 positioned therebelow; and insertion through holes 5 for positioning a plurality of blocks when they are layered on top of each other. As a result, blocks can be easily linked in the desired position both horizontally and vertically.

Following is a description of this embodiment assuming that the front side of the block 1 shown in FIG. 1 is on the outside wall side of the house or building. A first slanting surface 31 is positioned on the top of the linking protrusion 3 on the right of the approximate center which is slanted away from the inside wall side (one side) toward the outside wall side (other side). A second slanting surface 32 is positioned on the left on top of the linking protrusion 3 which is slanted away from the outside wall side (other side) toward the inside wall side (one side). Flat surfaces 33 and 34 that are higher than the slanting surfaces are also formed at both ends of these slanting surfaces. A center flat surface 35 that is higher than these slanting surfaces is formed as a boundary area between the first slanting surface 31 and the second slanting surface 32.

As shown in FIG. 1 and FIG. 2, the joint 2 formed at both ends of the block 1 is comprised of a vertical joining groove 21 which is located toward the ends of the block and is oriented away from the inside wall side and toward the outside wall side, and a joining protrusion 22 which protrudes from the inside wall side toward the outside wall side in such a way that a cuff is formed. The joint 2 on one side is formed so that it is oriented in the opposite direction as the joint on the other side. The joints 2 are horizontally linked by joining the joining protrusion 22 on one block with the joining groove 21 on an adjacent block 1.

As is clear from these explanations, the joints 2 and the respective slanting surfaces are formed so they are oriented in completely opposite directions, with the center flat surface 35 interposed between. Thus as shown in the figure, the sides, specifically, the inside wall side and the outside wall side are reversible. Consequently, when layer-building with these blocks 1, the joints 2 thereof can be easily linked without having to think about which side is the front and which the back.

The formation of a wall using the block of this embodiment is explained below.

In order to distinguish between a plurality of blocks, the blocks were labeled from 11 to 16 here.

As shown in FIG. 3, a wall is formed by layer building with a plurality of blocks 11 to 16. Vertical bars such as bolts 6, etc., are erected from the surface of a previously formed foundation (not depicted) or groundwork (not depicted) in a standing condition perpendicular thereto. These blocks are easily positioned in the desired position by layering the blocks on each other while inserting these bars through the insertion through holes 5. The blocks are horizontally linked as described above by joining with the joints 2 of the adjacent blocks.

The joint 2 of the overlaying block is positioned by the bolt 6 so that it is oriented in the approximate center of another block located therebelow. Specifically, by inserting the bolts 6 through the insertion through holes 5 of each block, the boundary surface 21*c* between the joining groove 21 and joining protrusion 22 of the joint of the block 13 is properly positioned in the approximate center of the center flat surface 35 of the block 12 therebelow. On the other hand, the side face 21*a* of the center of the joining groove 21 is within the area where the first slanting surface 31 is located therebelow.

Furthermore, in consideration of the gap between the bolts 6 and the insertion through holes 5, specifically, the slight amount of play therebetween, it is desirable if the width of the center flat surface 35 is formed so that it is larger than this gap.

How the rainwater is drained is explained next.

With a wall constructed with these blocks rainwater can penetrate through the elements in neighboring contact in the joint 2 where the blocks are horizontally linked. Specifically, as shown in FIG. 4, rainwater striking the side face 21*a* in the joint 2 flows downwards penetrating in the direction of the inside wall (Arrow A). The majority of the rainwater that flows down strikes the first slanting surface 31 and is drained to the outside wall side (Arrow B). However, due to the capillary phenomenon, a portion of the rainwater is horizontally transferred and falls on the back face 21*b* (Arrow C). However, this water runs into the boundary surface 21*c*, then eventually strikes the first slanting surface 31, and is drained to the outside wall side.

When a large amount of rainwater penetrates, even if it accumulates in the space formed by the first slanting surface 31 and the linking groove 4, because the flat surface 33 and the center flat surface 35 are formed to be higher than the first slanting surface 31, and moreover are adhered to the linking groove 4, they serve as a breakwater and completely prevent the rainwater from penetrating to the inside wall (See FIG. 1).

Furthermore, as described above, the block in this embodiment is formed to be inside/outside reversible, so exactly the same effect is obtained even when it is disposed so that the second slanting surface 32 slants in the direction of the outside wall side.

The insertion through holes 5 may be formed in such a way that the boundary surface 21*c* between the joining groove 21 and the joining protrusion of 22 of the joint 2 comes up on the slanting surface facing the outside wall side.

Embodiment 2

Inside/outside non-reversible blocks are explained in embodiment 2 of the present invention.

As shown in FIG. 13, the second slanting surface 32 of embodiment 1 is not present in the inside/outside non-reversible block 1*a*. In addition, the insertion through holes 5*a* are established in such a way that the entire width of the joining groove 23*a* is contained within the width of the slanting surface 31*a* that has been formed. Specifically, the insertion through holes 5 are established in such a way that when layering the blocks 1*a* by positioning them using the insertion through holes 5*a*, the entire joining groove 23*a* is always positioned entirely within the range of the slanting surface 31*a*. Furthermore, when viewed from the bottom, the shape of the block is the same as that of embodiment 1.

Consequently, leakage prevention measures are further realized in this embodiment as there is absolutely no fear of leakage occurring because this block contains no slanting surface which slants toward the inside wall side. Moreover, the strength is improved as the width of the flat surface is increased. However, during construction one must take care that the blocks are stacked so that the side on which the slanting surface 31*a* is formed is oriented toward the outside wall.

Embodiment 3

Embodiment 3 is used to explain a method for manufacturing wooden blocks used for constructing the most general-use log house such as is described in the opening paragraphs.

To manufacture the wooden blocks, a timber is first dried then machined into the aforementioned shape. However, cracks can occur when drying the timber, and cracks in the sides or connecting areas of the blocks are not only unsightly, but also effect the waterproofing structure of the blocks. Consequently, in this case, first the blocks are intentionally machined in such a way that cracks occur in places other than those described above, and then the blocks are shaped and formed.

Fundamentally, the timbers are oriented horizontally and used. However, it is preferred that a single piece of timber with a diameter that is greater than the height and depth of the block is used in such a way that the tree ring center will be positioned at the approximate center of the block, and is machined according to the steps described below.

(1) The cut timber is primarily dried by natural drying.

(2) A reference surface S is formed tangential to the tree rings, and a preliminary back cut 7 is made in the direction of the normal line to this. This reference surface S becomes the bottom surface of the block when it is formed, and it is desirable if its depth is about the depth of the linking groove 4. [FIG. 14(*a*)].

(3) The timber in which the back cut 7 has been made is put into an oven and secondarily dried. It is desirable if it is dried until the moisture content is the same as that of the timber used in the existing building. During this drying the timber shrinks in the direction of the circumference of the tree rings. Because a back cut 7 has already been made in this timber, cracks induced by this shrinkage can be prevented from occurring in places other than the back cut 7.

(4) Using the reference surface S of the secondarily dried timber as the bottom, the corners are cut off, and the linking groove 4 is formed in the back cut 7 area, then a block with the shape described above is machined (FIG. 14 (*b*)).

By manufacturing the blocks as described above, new cracks can be prevented from occurring in the wooden blocks, the beauty of the wood can be preserved, and leaks can be prevented. In addition, because the corners are cut off after the wood has been shrunk in the direction of the circumference, the height and depth of the blocks can be finished to be uniform, so that a flat wall can be obtained when they are layered on each other.

In addition, logs do not have to be used as the starting material in the aforesaid process; rectangular lumber can also be used as the starting material. In this case the same type of back cut is formed using a single side of the rectangular lumber as the reference surface. This is followed by the secondary drying, and then each surface is machined again to form the block.

It is not necessary to use a single piece of lumber in which the tree ring center is in the center of the material. Large-diameter timbers in which the tree rings form a sector, in other words, timber that has been halved or quartered can also be used. For example, when timber that has been quartered is used, as shown in FIG. 15, the same type of block can be formed by forming a reference surface S tangential to the tree rings, and making a back cut 7 therein.

The structure of the present invention described above makes it possible for a log house, etc., to be simply constructed by forming the walls by layer-building with these blocks. The present invention is superior to prior art in the following areas.

(1) With respect to measures for preventing the penetration of rainwater, the structure of the present invention makes it possible to prevent rainwater that has infiltrated through the connecting areas of the block from coming through to the inside wall side.

(2) By forming a flat surface in the linking protrusion, and adhering this to the linking groove, the surface area supporting the weight of the layered blocks is increased which reinforces its strength in the longitudinal direction.

As described above, blocks comprising the present invention can be layered on one another to form a wall, and particularly when they are made of wood, can be used to easily construct a log house.

What is claimed is:

1. A block, which, by layer-building with a plurality thereof, forms walls of houses or buildings, said block comprising:

hook-shaped joints established at both ends of said block;

a linking protrusion which has a protruding step that is formed on the top of the block and extends towards both ends thereof;

a linking groove which is established on the bottom face of the block and which links with the linking protrusion of another block positioned therebelow;

a first slanting surface positioned in the top of the linking protrusion to the right of the approximate center of said block, which is slanted away from one side and toward the other side; and a second slanting surface positioned in the top of the linking protrusion to the left of the approximate center of said block, which is slanted toward the aforesaid one side of the block and away from the aforesaid other side;

wherein a flat surface that is higher than each of the slanting surfaces is established in both ends of the aforesaid linking protrusion.

2. The block for walls of houses or buildings claimed in claim 1, further comprising a center flat surface that is higher than each of the slanting surfaces is established between the first slanting surface and the second slanting surface.

3. The block for walls of houses or buildings claimed in claim 1, further comprising:

an insertion through hole which is formed so that it passes through the top and bottom surfaces of the block;

said hook-shaped joints each having a vertical joining groove and joining protrusion, wherein said vertical joining groove at a first end of said block faces away from one side of the wall and toward another side, and wherein said vertical joining groove at a second end of said block faces away from said other side of the wall and towards said one side;

said joining protrusion which meshes with a joining groove of another adjacent block, wherein said insertion through hole is established in such a way that when layering the blocks while positioning them by passing a vertical bar through said insertion through hole, the side face of a center side of said joining groove which faces the outside wall side of the house or building, will be within the range of the slanting surface facing the outside wall side of the block positioned therebelow.

4. The block for walls of houses or buildings claimed in claim 2, further comprising:

an insertion through hole which is formed so that it passes through the top and bottom surfaces of the block;

said hook-shaped joints each having a vertical joining groove and joining protrusion, wherein, said vertical joining groove at a first end of said block faces away from one side and toward the other wall side, and wherein said vertical joining groove at a second end of said block faces away from said other side of the wall and towards said one side;

said joining protrusion which meshes with the joining groove of another adjacent block, wherein said insertion through hole is established in such a way that when layering the blocks while positioning them by passing a vertical bar through said insertion through hole, a boundary area between said joining protrusion and the joining groove of the joining groove facing the outside wall side of the house or building is positioned over the center flat surface of the block positioned therebelow.

5. The block for walls of houses or buildings claimed in claim 1, further comprising:

an insertion through hole which is formed so that it passes through the top and bottom surfaces of the block;

said hook-shaped joints each having a vertical joining groove and joining protrusion, wherein said vertical joining groove at a first end of said block faces away from one side and toward another wall side, and wherein said vertical joining groove at a second end of said block faces away from said other side of the wall and towards said one side;

said joining protrusion which meshes with a joining groove of another adjacent block, wherein said insertion through hole is established in such a way that when layering the blocks while positioning them by passing a vertical bar through said insertion through hole, a boundary area between said joining protrusion and the joining groove of the joining groove facing the outside wall side of the house or building is positioned over the slanting surface facing the outside wall side of the block positioned therebelow.

6. The block for walls of houses or buildings recited in claim 4 in which the width of the center flat surface is wider than a gap formed between the vertical bar and the insertion through hole.

7. The block for walls of houses or buildings claimed in claim 1, wherein said block is formed from wood.

8. A block, which, by layer-building with a plurality thereof, forms walls of houses or buildings, comprising:

hook-shaped joints established at both of its ends, wherein said hook-shaped joints each have a vertical joining groove and joining protrusion, wherein said vertical joining groove at a first end of said block faces away from one side of the wall and toward another side, and wherein said vertical joining groove at a second end of said block faces away from said other side of the wall and toward said one side;

a linking protrusion which has a protruding step that is formed on the top of the block toward both ends thereof;

a linking groove which is established on the bottom face of the block and which links with the linking protrusion of another block positioned therebelow; and a slanting surface formed on a top face of said linking protrusion which is slanted away from an inside of said wall toward an outside of said wall;

flat surfaces established at both ends that are higher than said slanting surface;

a hook-shaped joint respectively having a vertical joining groove and joining protrusion, said vertical joining groove which faces away from one side and toward the other side;

said joining protrusion which faces toward said one side and away from said other side;

and is formed in such a way that said hook-shaped joints face in opposite directions so that the aforesaid joining protrusion will join with the aforesaid joining groove.

9. The block for walls in houses or buildings claimed in claim 8, wherein when a wall is formed by layering a plurality of said blocks on each other while joining their joints, these blocks are formed in such a way that the side face of the center of the joining groove facing the outside wall side of the house or building will be over the aforesaid slanting surface of the block positioned therebelow.

10. The block for walls in houses or buildings claimed in claim 8, wherein when a wall is formed by layering a plurality of said blocks on each other while joining their joints, these blocks are formed in such a way that the boundary area between the joining protrusion and the joining groove facing the outside wall side will be over the aforesaid slanting surface of the block positioned therebelow.

11. The block for walls of houses or buildings claimed in claim 8, wherein, said block is formed from wood.

12. A method for manufacturing a wooden block for use in the construction of walls for houses or buildings, comprising:

selecting a piece of timber having a diameter greater than a height and a depth of said block;

forming a reference surface tangential to the tree rings, wherein said reference surface forms a bottom surface of said block;

forming a preliminary back cut in a direction normal to the reference surface and at a depth corresponding to a depth of a linking groove;

drying said timber;

cutting said timber along planes perpendicular to said reference surface to form a front, a back, a left and a right side of said block; and forming said linking groove, a linking protrusion, a joining groove, and a joining protrusion, wherein the linking groove is formed in the back cut area.

13. The method of claim 12, further comprising forming a plurality of insertion through holes extending from said bottom of said block to said top of said block.

14. The method of claim 12, further comprising forming a first slanting surface and a second slanting surface, wherein a center flat surface is formed between said first and second slanting surfaces.

15. The method of claim 12, further comprising a second step of drying.

* * * * *